United States Patent [19]

Gueret

[11] Patent Number: 4,964,541

[45] Date of Patent: Oct. 23, 1990

[54] DISPENSING DEVICE FOR MIXING AN ADDITIVE

[75] Inventor: Jean-Louis Gueret, Paris, France

[73] Assignee: L'Oreal, Paris, France

[21] Appl. No.: 329,763

[22] Filed: Mar. 28, 1989

[30] Foreign Application Priority Data

Mar. 28, 1988 [FR] France ..... 88 04022

[51] Int. Cl.[5] ..... B67D 5/60

[52] U.S. Cl. ..... 222/137; 222/144.5; 222/145; 222/206

[58] Field of Search ..... 222/94, 135–137, 222/144.5, 145, 189, 190, 206

[56] References Cited

U.S. PATENT DOCUMENTS

| | | | |
|---|---|---|---|
| 3,010,613 | 11/1961 | Stossel | 222/190 |
| 3,013,698 | 12/1961 | Gordon et al. | 222/158 |
| 3,042,263 | 7/1962 | Gallo, Sr. | 222/94 |
| 3,110,423 | 11/1963 | Hegedic et al. | 222/145 |
| 3,128,915 | 4/1964 | Matter | 222/158 |
| 3,152,731 | 10/1964 | Prussack | 222/94 |
| 3,182,860 | 5/1965 | Gallo . | |
| 3,282,474 | 11/1966 | Gorman | 222/136 |
| 3,543,967 | 12/1970 | O'Connor | 222/145 |
| 3,814,287 | 6/1974 | Darbon et al. | 222/136 |
| 4,585,149 | 4/1986 | Zulauf | 222/94 |
| 4,676,410 | 6/1987 | von Flue | 222/137 |

FOREIGN PATENT DOCUMENTS

| | | | |
|---|---|---|---|
| 2943890 | 5/1981 | Fed. Rep. of Germany | 222/94 |
| 1341226 | 9/1963 | France . | |
| 1532355 | 6/1968 | France . | |

*Primary Examiner*—Grant H. Skaggs
*Assistant Examiner*—Steve Reiss
*Attorney, Agent, or Firm*—Cushman, Darby & Cushman

[57] ABSTRACT

The device includes a container (301) and a dispenser head (302) including a central channel (314) closed by a side wall (312) and open on both ends. The side wall (312) includes at least one auxiliary channel (345). The dispenser head (302) includes a reservoir (322) containing a additive (304). A piston (351) is disposed in the reservoir (322) and is arranged to slide in a sealed manner, the piston (351) separating the additive (304) from the substance (303) that serves to propel it outside the cap and which originates in the container. The side wall (312) of the central channel, at its end located on the side of the outlet, includes passages formed by cuts (345), and a dispenser spout (357) is mounted to rotate on the corresponding end of the cap. The spout (357) includes size modifying passages for the free cross section of the passages (345) depending on the angular position of the spout.

9 Claims, 2 Drawing Sheets

DISPENSING DEVICE FOR MIXING AN ADDITIVE

BACKGROUND OF THE INVENTION

The invention relates to a device for dispensing a mixture of pasty substance and at least one additive, in particular in the form of a striped ribbon. The device is of the type including a container and a dispenser head that is provided with a closure means and is fixed on the container by fixation means cooperating with means for keeping them connected to the container. The head includes a central channel, open at two ends and closed by a side wall, that discharges into an outlet conduit from the head, and the side wall includes at least one auxiliary channel. The dispenser head comprises a removable cap, which includes a reservoir that contains the additive and communicates with the outlet conduit from the cap via at least one of the channels.

SUMMARY OF THE INVENTION

The primary object of the invention is to make this device more responsive than at present to various practical requirements, and in particular to enable the proportion of pasty substance and additive in the striped ribbon to be modified. Moreover, it is desirable for the two products to come into contact with one another as late as possible, to avoid chemical, physical or other incompatabilities. This also makes it possible to dispense two products of different viscosities.

According to the invention, in a device of the generic type defined above, the side wall of the central channel, at its end located toward the outlet, includes passages formed in particular by cuts, and a dispenser spout is mounted for rotation on the corresponding end of the cap, the dispenser spout including means for modifying the free cross section of the passages depending on the angular position occupied by the dispenser spout.

The device advantageously includes a plug that has a flange arranged to close the passages of the wall of the central channel.

The dispenser head preferably includes a piston disposed in the reservoir containing the additive and arranged to slide in a sealed manner in this reservoir: the piston separates the additive from the substance which serves to propel it outside the cap.

The reservoir containing the additive may comprise the internal portion of the central channel and communicates with the outlet orifice from the cap by one end of the central channel; the piston is accommodated in the internal portion of this central channel, and the face of the piston toward the outlet is disk-shaped.

The disk may be bordered with a flange oriented toward the side opposite the outlet from the cap.

Preferably, the internal portion of the central channel, at its end opposite the outlet of the additive, includes means for retaining the piston; in particular, these retaining means comprise a rim that projects radially inward.

The cap may advantageously be made of transparent material, and at least one radial partition can connect the inside surface of the casing and the outside surface of the reservoir, to make it possible for the level of contents in the reservoir to be seen.

In another possibility, the reservoir containing the additive comprises the space surrounding the central channel and included between the outer side wall of this central channel and the inner side wall of the casing of the cap. This space communicates with the outlet orifice from the cap via at least one opening or passage formed by a cut, and in that case the piston is in the shape of a ring, including a central hole the edge of which is arranged to slide in a sealed manner against the outer wall of the central channel, while the outer edge of the ring is arranged to slide in a sealed manner against the inside wall of the casing of the cap.

The amount of the product that passes through the openings of adjustable cross section may vary from a maximum value to a zero output, corresponding to total closure of the openings.

In a particularly simple solution, two angular reference positions are provided for the dispenser head, corresponding to two different passage cross sections.

Thus it is possible to modify the relative proportions of the substance and the additive in the ribbon produced. The primary container comprises one element of a set embodied by a stick having a screw thread, a flexible tube, a piston or pump dispenser, or a pressurized container of the aerosol foam type; connection means are provided between the additive cap and the main container to assure good retention of the two parts and to prevent rotation of the cap or dispensing of the additive.

The invention also relates to a dispenser head for such a device, which includes the characteristics recited above.

With the above provisions as the point of departure, the invention also comprises a certain number of other arrangements, which are described in further detail below in terms of exemplary embodiments shown in the accompanying drawings, although it is to be understood that these are in no way limiting.

DESCRIPTION OF THE PREFERRED EMBODIMENTS

Figure 2:
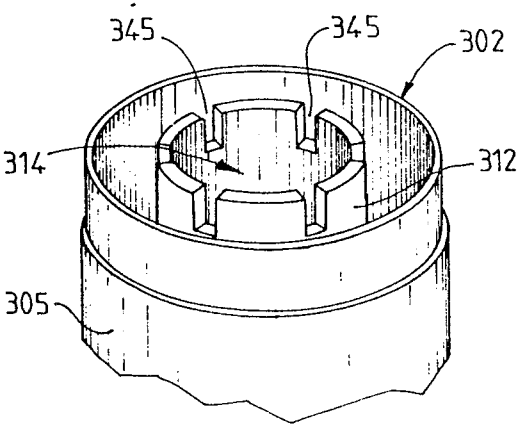
FIG. 2 is a perspective view of the upper end of the cap, with the dispenser spout having been removed from the cap.
Figure 1:
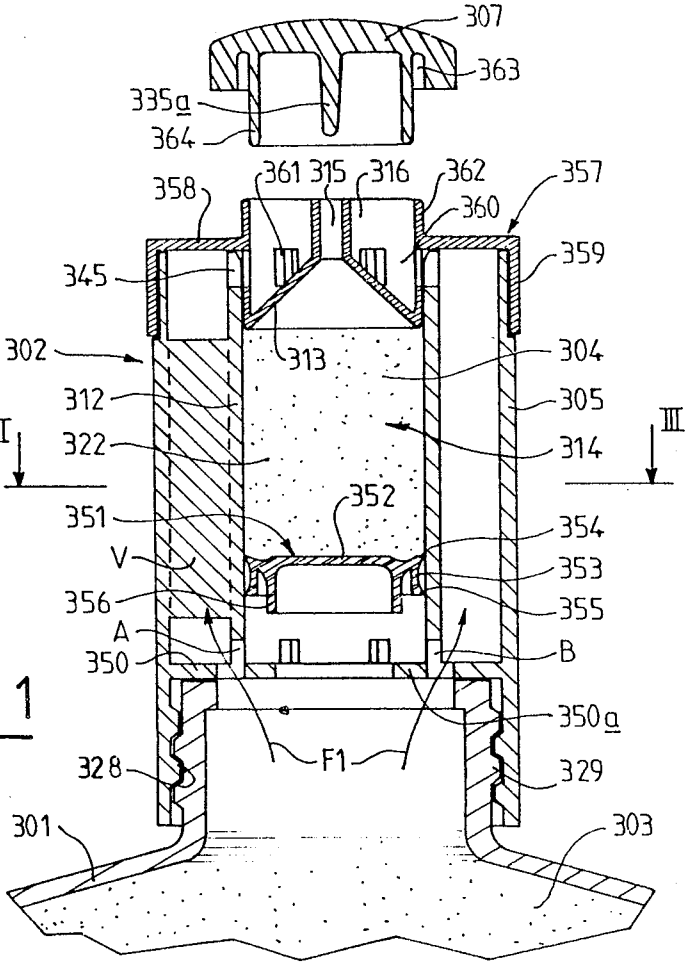
FIG. 1 is an axial section of a first exemplary embodiment of the device according to the invention, in which the cap is mounted on a container and the closure means for the cap are spaced apart from it.

Turning now to FIGS. 1 and 2, a device is shown for dispensing a mixture of pasty substance 303, which is contained in a container 301, and a additive 304, which is provided in a reservoir 322. The reservoir comprises the internal portion of a central channel 314 provided in a dispenser head 302, or tracing dispenser, which is independent of the container 301. The head may receive a plug 307 and is fixed on the container 301 with the aid of an internal thread 328 arranged to cooperate with a corresponding external thread 329 provided on the neck of the container 301.

The container 301 may comprise a flexible tube, a pump or piston container, or an aerosol can, with or without a pouch.

The reservoir 322 is closed in its upper portion by a conical wall 313 that at its top includes an orifice 315 lengthened by an outlet shaft that discharges into the outlet conduit 316 of the cap. The plug 307 includes a central protrusion 335*a* arranged to engage the inside of the orifice 315 so as to close it.

The annular space included between the outer surface of the cylindrical wall 312 of the reservoir and the inside surface of the casing 305 of the cap allows for the passage of the pasty substance 303 coming from the container 301. Lower lateral passages such as A, B are provided in the lower portion of the cylinder 312, and in a transverse wall 350 which connects the cylinder 312 to the outer casing 305, and thus to the cylindrical flange including the internal thread 328.

Figure 3:
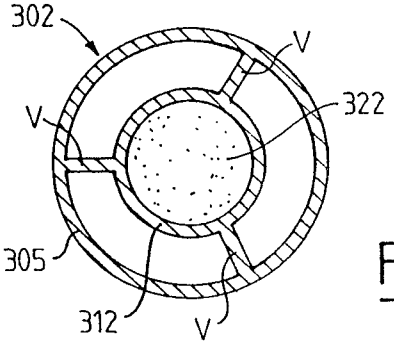
FIG. 3 is a section on a smaller scale taken along the line III—III of FIG. 1.

Advantageously, the walls of the casing 305 and of the reservoir 322 are made of transparent material, and at least one radial partition V, made of the same material, joins the inside surface of the casing 305 to the outside surface of the reservoir 322. Preferably, a plurality of partitions V are distributed at regular angular intervals, as shown in FIG. 3. These partitions V extend longitudinally along the useful length of the reservoir 322. The partitions V effect a transparent connection, making it possible to see the level of the contents in the reservoir 322.

The cap 302 is then molded completely of a transparent material.

At its upper end, the cylinder 312 includes openings in the form of cuts 345 to permit the product coming from the container 301 and passing along the annular space to flow through the wall of the cylinder 312 and arrive in the outlet conduit 316.

The dispenser head includes a piston 351, disposed in the reservoir 322 and arranged to slide in a sealed manner in the reservoir. The piston 351 separates the additive 304 from the pasty substance 303 and is located at the bottom of the reservoir 322 when the reservoir is first put to use by being filled with the additive. The face 352 of the piston oriented toward the outlet of the reservoir is in the shape of a solid disk and is bordered on its periphery by a flexible flange 353 oriented toward the bottom of the reservoir 322 and arranged to establish a tight seal with respect to the internal wall. The cross section of this flange is concave in shape, toward this internal wall. The flange 353 includes two peripheral support lips 354, 355. The disk 352 is integrally joined to a cylindrical wall 356 that opens toward the container 301; the outside diameter of this cylindrical wall is less than the inside diameter of the flange 353.

The transverse wall 350 includes a rim 350*a*, which projects radially toward the inside in the central channel 314 and comprises retention means of the piston 351.

The end of the cap located on the side of the outlet of the product is equipped with a dispenser spout 357 mounted to rotate on this end. The spout is formed by a ring 358, the outer edge of which is integrally joined to a cylindrical flange 359 that tops the end of the wall 305 having reduced thickness; the ring 358 includes a central hole, the edge of which is integrally joined to a cylindrical flange 360 arranged to engage the inside of the reservoir 322 in a sealed manner. This internal flange has openings 361, in particular of rectangular shape, in its wall that by rotation of the spout 357 can be placed such that they completely or partially face the cuts 345, which makes it possible to vary the proportion of pasty substance relative to the additive in the ribbon dispensed by the spout 357. For example, two reference positions of the spout 357 can be provided, corresponding to a variation of from once to twice the proportion of pasty substance to additive. Advantageously, the conical wall 313 is integrally joined at its base to the lower edge of the flange 360.

On the side opposite the cap, the spout 357 includes a cylindrical collar 362, the top of which is engaged by the plug 307 via an internal throat 363.

This throat 363 is defined radially toward the inside by a cylindrical flange 364 that projects toward the bottom and is sufficiently long to close the openings 361 and the cuts 345 when the plug 307 is in place on the spout 357. Thus the cap 302 can be stored in readiness for being mounted on a container 301. The plug 307 and the flange 364 can be snapped or locked into place in the spout 357 to close it in a sealed manner.

The functioning of the device of FIGS. 1 and 2 will be immediately apparent from the above description.

When pressure is exerted on the wall of the reservoir 301, which generally comprises a collapsible tube, the pasty substance 303 passes via the openings A, B, as indicated by the arrows Fl in FIG. 1, to flow via the annular space in the direction of the openings 345.

Simultaneously, some of the pasty substance 303 penetrates via the reservoir 322 and pushes on the piston 351. The additive 304 is thus expelled via the central opening 315, so as to form a central streak inside the peripheral ribbon of pasty substance that flows via the passages 345 and the openings 361.

As described above, by choosing an angular position of the spout 357 with respect to the cap, the proportion of the two ingredients can be adjusted. Such adjustment is advantageous for instance in the case of a cream (pasty substance 303) combined with a sun block ( additive 304). By adjusting the spout 357, the user can regulate the rate of protection of the mixture from the container 301.

Graduations and a pointer may be provided on the outer walls 305 and on the outer surface of the flange 359, respectively, for marking the angular position of the spout 357.

The piston 351 makes it possible to avoid any premature mixing or migration of the pasty substance 303 into the additive 304, which is of a different color. Thus the additive 304 remains perfectly intact when the cap is mounted on the container 301.

When the additive 304 has been completely evacuated, the pasty substance does not pass through the orifice 315 in any case, and it is instantly apparent that the supply of additive 304 is exhausted, and that it is necessary to replace the spent cap with another cap 302.

When the cap 302 is in storage, ready for use, the additive 304 will be protected at the bottom by the tightness of the piston 351 and at the top by the tightness of the protrusion 355*a* of the plug 307 and the internal flange 364 that closes the cuts 345.

After one use, that is, after having pressed upon the container 301 to expel some of the substance, a re-intake of air can take place. The piston 351, which may recoil, prevents an aspiration of the additive into the container 301. The passages A, B, and so forth provided for the pasty substance 303 make it possible for the substance to be drawn back into the container 301 before the piston 351 returns.

It should be noted that when the dispenser spout 357 occupies a position corresponding to a large passageway cross section for the set of cuts 345 and openings 361 for the pasty substance 303, the pressure to be exerted on the container 301 to dispense this pasty substance will be slight. In an extreme case, this pressure might be insufficient to displace the piston 351, such that if desired, the ribbon obtained at the outlet of the dispenser spout 357 will be formed solely by the pasty substance 303, without any additive 304.

As applicable, the cap 302 may be set to correspond to one dose (for example, five doses might be sufficient to exhaust the contents of the container or tube 301), or it may be mounted at a permanent location after storage, for the entire duration of use of the container or tube 301.

This device may also be well suited to cosmetic products, hair products or sun screens, or even pharmaceuticals. The cap may include any kind of applicator elements, such as spherical tips, spatulas, sponges, etc.

The variation in the passageway cross sections of the openings may result either from a simple rotational movement of the dispenser spout 357, as in FIG. 1, in which case the change in cross section is substantially due to a change in the peripheral width of the opening, or to a combined rotational and axial sliding motion of the dispenser spout, in which case a variation in the height of the passageway cross section of the openings is brought about.

The axial slidinq of the dispenser spout corresponds to a rise or fall of the spout on the body of the dispenser.

The combined movement of rotation and axial sliding of the dispenser spout may be obtained by a system of linked helical ramps, provided on the dispenser spout and the wall of the cap, or by some equivalent system.

The dispenser spout may be in the form of a rotary pushbutton, and the cap or dispenser may include anti-rotation and guide ribs that engage corresponding grooves provided in the upper portion of the reservoir.

Figure 5:
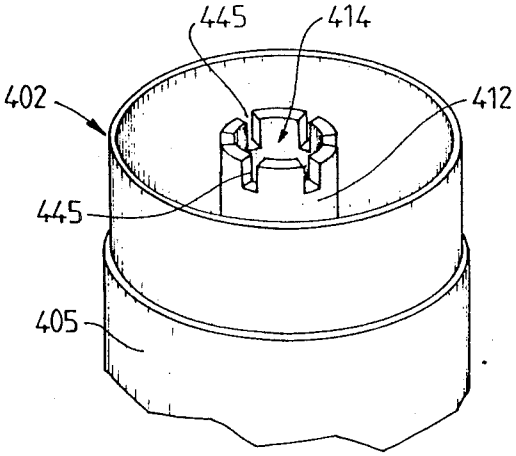
FIG. 5 is a perspective view of the upper end of the cap of FIG. 4, with the dispenser spout having been removed.
Figure 4:
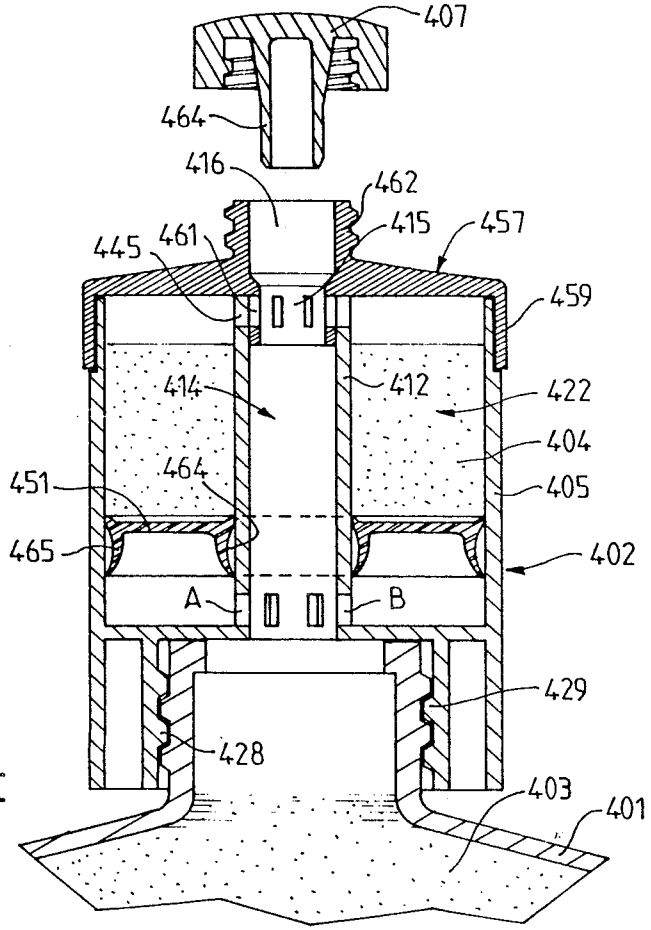
FIG. 4 is an axial section similar to FIG. 1 of a second exemplary embodiment.

Turning to FIGS. 4 and 5, a variant embodiment of the distribution device can be seen, in which the reservoir 422 containing the additive 404 comprises the annular space surrounding the central channel 414, this space being included between the cylindrical wall 412 that defines the channel 414 and the internal side wall of the casing 405.

Those elements of the device of FIGS. 4 and 5 that play a similar role to that of elements described above in connection with FIGS. 1 and 2 are identified by a reference numeral differing only in that it is raised by 100 over the reference numerals used for FIGS. 1 and 2. Accordingly, these elements will not be described again here, or will be described only briefly, since the above explanation pertains equally to them.

The piston 451 of FIG. 4 is in the form of a ring, including a central hole, the edge of which is provided with an internal flange 464 arranged to slide in a sealed manner against the outer wall of the central channel. The outer edge of this ring is also provided with a flange 465 that slides in a sealed manner against the inside wall of the casing 405. Both flanges are oriented toward the bottom of the cap. At the base of the wall 412 of the central channel, openings A, B, and so forth are provided to permit the pasty substance 403 originating in the container 401 to penetrate the annular space behind the piston 451, in order to push the piston. The upper end of the wall of the central channel includes cuts 445 to permit the additive 404 to flow radially to the interior and form stripes on the periphery of the central strand or ribbon originating in the channel 414.

The cap is topped by a dispenser spout 457 mounted for rotation, which includes a central passage 415 and openings 461 arranged to come into a position that partially or totally faces the cuts 445, to enable adjustment of the proportions of the products.

The dispenser spout 457 includes a neck 462 provided with an external thread on which the closure plug 407 can be screwed.

The functioning of the device of FIGS. 4 and 5 will be immediately apparent from the above explanation.

By pressing on the walls of the reservoir 401, generally formed by a tube, the expulsion of the substance 403 is brought about, and the substance flows via the central channel 414 and simultaneously passes through the openings A, B, and pushes on the piston 451.

The additive 404, under the influence of the piston 451, is expelled through the cuts or crenellations 445 and the openings 461. This additive forms stripes of a different color, the width of which will depend on the dosage position dictated by the dispenser spout 457, on the outside of the ribbon of pasty substance 403 passing through the opening 415.

All the advantages mentioned in connection with FIGS. 1 and 2 are retained in the embodiment of FIGS. 4 and 5.

This embodiment of FIGS. 4 and 5 makes it possible to reduce the output of additive down to a value of zero, by totally closing off the openings 445 by rotation of spout 457.

The dispenser spout 457 could be arranged in the form of a pouring spout having a lateral outlet appendage. By providing complementary helical ramps between the outer wall of the casing 405 and the flange 459, the rise or fall of the spout 457 during its rotation can be brought about. In a variant, the central channel 412, instead of surrounding the central passage 415, as shown in FIG. 4, may engage the inside of the passage 415; with a lateral outlet on the spout 457, a bottom can be provided in the upper portion that includes a downwardly pointing protrusion arranged to close the channel 412 when the spout 457 is lowered. In either variant, the dispenser will readily function to apply the mixed constituents with accuracy to a site or along a line.

In general, the axial course of the pouring spout is provided so as to enable the complete closure of the lateral openings first, and only after that the closure of the channel 412 by the protrusion.

In the above examples, the additive may have a pasty consistency but it is possible to use other constituents also having a highly liquid formulation as described below.

In either of the embodiments, one may dispose in the reservoirs, 322 or 422, a sponge material such as an open cell polymeric material. The sponge may occupy the volume of the additive material 304 or 404 as shown in the drawings. The sponge material will be impregnated with the liquid additive to which one may add a certain quantity of a tensio-active material. Upon each compression of the sponge, resulting from movement of the piston 351, 451, upon pressure from the movement of the pasty substance 303, 403, a certain volume of the liquid additive is expelled from the sponge and distributed with the pasty substance.

Where a tensio-active material has been added to the liquid additive, the additive upon dispensing will take on the form of foam or "mousse", upon each dispensing from the sponge and mixing with the pasty substance to form the striped band or ribbon.

What is claimed is:

1. A dispensing device for cooperation with a container of the type having an outlet opening, said device serving as a removable cap for the container and dispensing an additive with the contents of the container in a mixture of a pasty substance such as in the form of a stripped strand, said device including means for mounting said device on the outlet opening to close the opening, said device comprising:

an integrally molded cap having an inlet end and an outlet end, the inlet end fitting on the outlet opening of the container, the cap including:

a cylindrical wall defining a central channel and having lateral passages provided in a first portion thereof adjacent said inlet end and openings in a second portion thereof adjacent said outlet end, said cylindrical wall defining at least in part a reservoir for the additive;

an outer casing defining an annular space between an outer surface of said cylindrical wall and an inner surface of said casing; and a transverse wall that connects said first portion of the cylindrical wall with the outer casing;

an integrally formed dispenser spout rotatably mounted on the outlet end of the cap and including:

a ring forming said spout and having an edge joined to a flange fitting on said outer casing; and a cylindrical member connected to an inner surface of said cylindrical wall, said cylindrical member having openings therein, the openings in said cylindrical member being rotatable with said spout so as to vary the extent to which the openings are covered in the second portion of the cylindrical wall, thus allowing variation of a proportion of said pasty substance relative to the additive; and a piston slidably disposed in the reservoir, said piston moving in response to dispensing of contents from the container so as to dispense the additive from the reservoir while separately maintaining the contents of the container from the additive.

2. The device as claimed in claim 1, wherein said reservoir is defined by at least a portion of said central channel with said piston being disposed in said central channel and having a face facing said one end of said central channel, said face being in the shape of a disk.

3. The device as claimed in claim 2, wherein said disk has a peripheral edge provided with a flange extending toward the opposite end of said central channel from said one end.

4. The device as claimed in claim 3, wherein said central channel is provided with a rim for retaining said piston at said opposite end of said central channel.

5. The device as claimed in claim 1 wherein said device includes plug means having a flange to close said openings of said central channel when said plug means closes said second portion.

6. The device as claimed in claim 1 wherein said device is made of transparent material.

7. The device as claimed in claim 1, wherein a container is connected to said device and said container is provided with a screw thread cooperating with said mounting means of said device.

8. The device as claimed in claim 1, wherein a container is connected to said device and said container is a flexible tube.

9. The device as claimed in claim 1, wherein said reservoir includes a sponge material disposed therein and impregnated with a liquid additive.

* * * * *